US005142715A

United States Patent [19]

Ogle et al.

[11] Patent Number: 5,142,715

[45] Date of Patent: Sep. 1, 1992

[54] FOUNDATION UNIT WITH SNAP-FIT MODULAR SPRINGS

[75] Inventors: Steven E. Ogle; Danny L. Wylie, both of Carthage, Mo.

[73] Assignee: Leggett & Platt, Incorporated, Carthage, Mo.

[21] Appl. No.: 827,007

[22] Filed: Jan. 28, 1992

Related U.S. Application Data

[63] Continuation-in-part of Ser. No. 786,021, Oct. 31, 1991.

[51] Int. Cl.[5] ..... A47C 23/04; A47C 23/053

[52] U.S. Cl. ..... 5/247

[58] Field of Search ..... 5/247, 255, 476, 263, 5/260, 267; 267/103

[56] References Cited

U.S. PATENT DOCUMENTS

| | | | |
|---|---|---|---|
| 3,833,948 | 9/1974 | Surletta et al. | 5/247 |
| 4,000,531 | 1/1977 | Imman | 5/267 |
| 4,068,329 | 1/1978 | Gross et al. | 5/255 |
| 4,398,705 | 8/1983 | Mizelle | 5/255 |
| 4,828,233 | 5/1989 | Hagemeister | 5/248 |
| 4,838,528 | 6/1989 | Hagemeister | 4/255 |
| 5,005,809 | 4/1991 | Harmon | 5/247 |

*Primary Examiner*—Alexander Grosz
*Attorney, Agent, or Firm*—Wood, Herron & Evans

[57] ABSTRACT

A bedding foundation unit having a top planar portion defined by two pluralities of spaced parallel grid wires, and a rigid frame spaced apart from the top planar portion by a plurality of modular springs. Most, if not all, of the modular springs extend longitudinally of the foundation and are connected to the top planar portion in a snap-fit manner, each snap-fit end of each modular spring being held in place by three grid wires above and one grid wire below the snap-fit end.

14 Claims, 4 Drawing Sheets

FOUNDATION UNIT WITH SNAP-FIT MODULAR SPRINGS

Related Application

This application is a continuation-in-part application of United States patent application Ser. No. 07/786,021, filed Oct. 31, 1991.

FIELD OF THE INVENTION

This invention relates to foundation units and, more particularly, to foundation units with modular springs having snap-fit connections.

BACKGROUND OF THE INVENTION

Foundation units are well known. Typical foundation units include a rigid frame and a top planar portion disposed above the frame by numerous spring elements. The top planar portion is typically defined by a welded wire grid. The spring elements are typically stapled to the wooden frame below and clipped or welded to the wire grid above. Typically a pad is placed over the top planar portion and the entire assembly is surrounded with a cover.

Foundation units which use modular springs for the spring elements are also known. For example, a modular spring and a foundation unit based on that modular spring are shown in U.S. Pat. No. 3,833,948, assigned to the assignee of the present invention, the disclosure of which is fully incorporated herein by reference. However, these modular springs are typically connected to the upper wire grid by clips, welding, or other means requiring special equipment and substantial labor. Consequently, the foundation unit cannot be manufactured as economically as desired.

Thus, it is desirable to be able to attach the modular springs to the planar top portion without requiring clips or welds etc. Several techniques for attaching the modular springs to the planar top portion without the use of clips or welds are shown, for example, in U.S. Pat. Nos. 4,828,233, 4,838,528, and 5,005,809. However, these patented techniques either require a series of complex bends to be made in relatively complex modular spring elements or require numerous grid wires and/or modules to make a satisfactory foundation.

SUMMARY OF THE INVENTION

An objective of the present invention is to provide an economical bedding foundation in which only modular springs are used and most, if not all, of the modular springs are secured to the grid wires of the top planar portion of foundation units, without the use of clips, welds or other means requiring special equipment and substantial labor.

The present invention achieves this objective by providing a simplified snap-fit connection between standard modular springs and the grid wires of the top planar portion.

In accordance with the principles of the present invention, the number of, the placement of, and the design of the grid wires of the top planar portion of a bedding foundation are modified to form a snap-fit connection between most, if not all, of the modular springs and the grid wires.

More specifically, each modular spring has a section at its upper end which can be used in a snap-fit connection. This upper or snap-fit section may be visualized as four bends in a piece of straight wire that form five coplanar segments: a centermost longitudinal section, two longitudinal end sections, each being parallel to but offset from the centermost longitudinal section, and being connected thereto with a transverse straight portion. The planar top portion of the foundation is defined by two pluralities of spaced parallel grid wires, each plurality lying perpendicular to the other. The snap-fit section of the modular spring can be connected to four grid wires of the planar top portion as follows: One grid wire from the second plurality of spaced parallel grid wires extends over both transverse straight portions of the modular spring. A second grid wire from the second plurality extends under both transverse straight portions. Finally, a pair of grid wires from the first plurality of spaced parallel grid wires extends over the longitudinal end sections in such a manner that one grid wire extends over each longitudinal end section. Thus, when the snap-fit connection is used, the snap-fit section of the modular spring is held in place by one grid wire extending under and three grid wires extending over the various segments of the snap-fit sections.

The advantage of a bedding foundation formed in this manner and having modular springs of this construction is that it provides a very economical foundation which may be easily and economically assembled without the use of any special tools.

These objectives and advantages are satisfied by the invention of the above-identified application of which this application is a continuation-in-part application. But in that application, the modular springs are generally arranged to extend transversely across the foundation while in the practice of the invention of this application, the springs extend longitudinally of the foundation.

These and other objects and advantages of the present invention shall become more readily apparent from the following detailed description taken in conjunction with the drawings herein, in which:

DETAILED DESCRIPTION OF THE PREFERRED EMBODIMENTS

Figure 1:
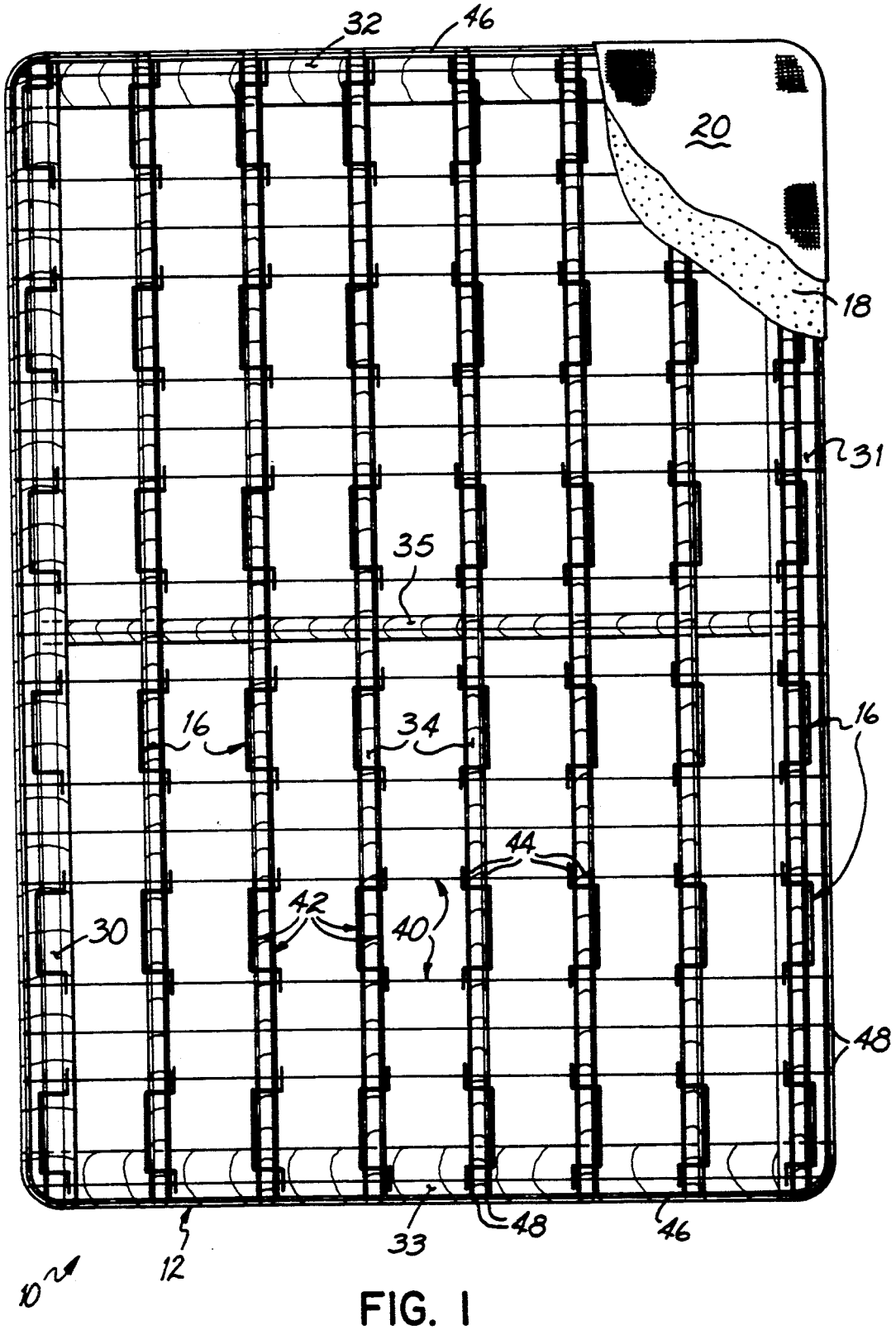
FIG. 1 is a top plan view, mostly broken away, of a foundation unit incorporating the present invention.
Figure 2:
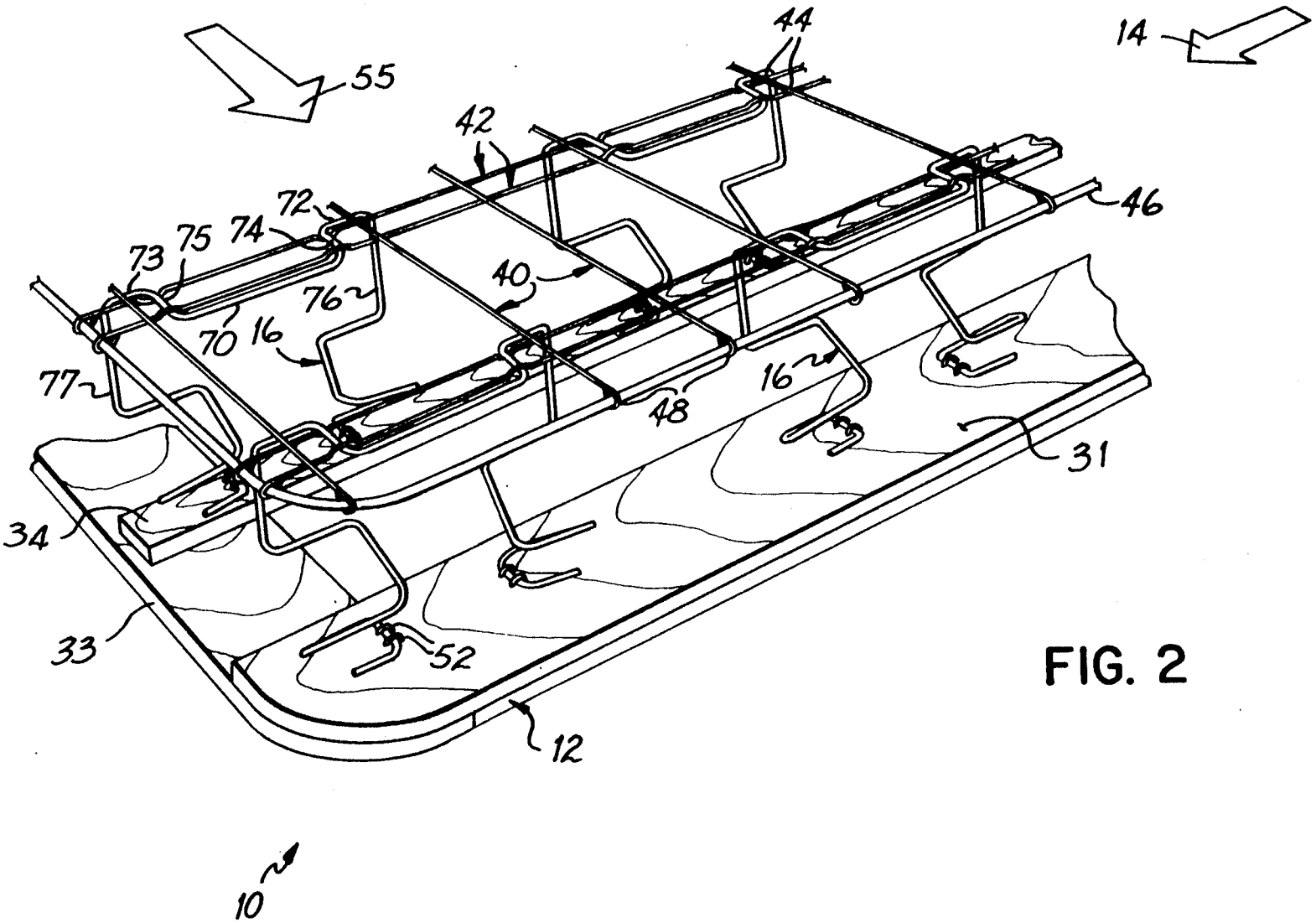
FIG. 2 is a perspective view of a corner portion of the bedding foundation unit of FIG. 1.
Figure 3:
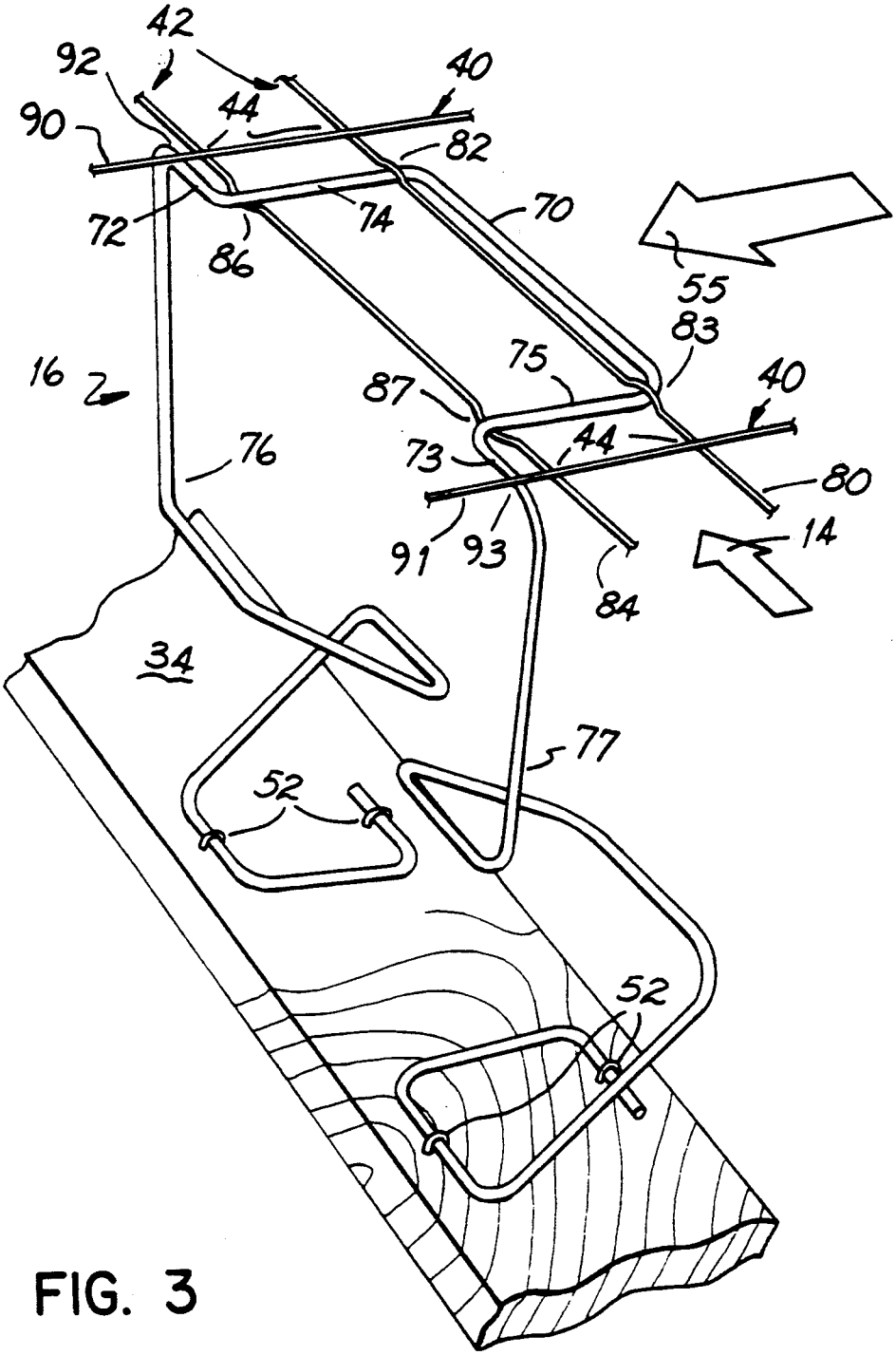
FIG. 3 is a perspective view of one modular spring in snap-fit connection with part of the planar top portion of a foundation unit according to the present invention.

With reference first to FIGS. 1–3, there is illustrated a foundation unit 10 employing one embodiment of the present invention. This foundation unit comprises a frame 12, a planar top portion 14, and a plurality of modular springs 16. A pad 18 rests on the top surface of the planar top portion 14. An upholstered covering 20 encases the frame 12, the planar top portion 14, the plurality of modular springs 16, and the pad 18.

The frame 12 comprises two laterally spaced longitudinal frame members 30 and 31, two longitudinally spaced lateral frame members 32 and 33, and a plurality of longitudinally extending slats 34 and a cross-slat 35. These members 30, 31, 32 and 33 and slats 34 and 35 are all secured by nails or other suitable means to provide a rigid frame 12 for the foundation unit, such that slats 34 are generally parallel to longitudinal frame members 30 and 31 and generally perpendicular to lateral frame members 32 and 33, and cross-slat 35 is generally parallel to lateral frame members 32 and 33 and perpendicular to longitudinal frame members 30 and 31.

The planar top portion 14 is defined by a first plurality of spaced parallel grid wires 40 and a second plurality of spaced parallel grid wires 42 lying perpendicular to and connected to the first plurality of grid wires 40. Individual grid wires 40 and 42 are interconnected by welds or other suitable means at the points at which they cross 44.

Referring to FIG. 2, it will be seen that the boundary of the planar top portion 14 is defined by border wire 46. Grid wires 40 and 42 are connected to border wire 46 at 48 by welding or by wrapping (as shown in FIG. 2), or in the preferred embodiment by both wrapping and welding.

In the first embodiment of the invention illustrated in FIGS. 1–3, only modular springs 16 which extend longitudinally are used and only in a single spring attachment configuration (see FIG. 1). The frame 12 and the planar top portion 14 are spaced apart by a plurality of modular springs 16. The modular springs 16 are attached or connected to the planar top portion 14 and connected to and interspaced along the length of said longitudinal frame members 30 and 31 and slats 34. Each modular spring 16 comprises a planar top section 55 at its upper end and two vertical legs 76 and 77 at its base. Modular springs 16 are attached at the terminal ends of vertical legs 76 and 77 to the top surface of longitudinal frame members 30 and 31 and slats 34 by means of staples 52 or by other suitable means. The planar top sections 55 at the upper ends of modular springs 16 are snapfitted into the two pluralities of spaced parallel grid wires 40 and 42, which define the planar top portion 14 This snap-fit connection will be described in greater detail below.

Referring now to FIG. 3, the planar top section 55 of each modular spring 16 comprises five segments: a centermost longitudinal section 70; two coplanar longitudinal end sections 72 and 73, parallel to and coplanar with centermost longitudinal section 70; and two transverse straight portions 74 and 75, coplanar with and connected between centermost longitudinal section 70 and longitudinal end sections 72 and 73. This planar top section 55 of each modular spring 16 may best be thought of as four bends in a single wire forming the five coplanar segments 70, 72, 73, 74 and 75.

The planar top section 55 of each modular spring 16 connects to the grid wires 40 and 42 of coplanar top portion 14 as shown in FIG. 3. One grid wire 80 of the second plurality of spaced parallel grid wires 42 extends over transverse straight portions 74 and 75 at 82 and 83, respectively. A second grid wire 84 of the second plurality of spaced parallel grid wires 42 extends under transverse straight portions 74 and 75 at 86 and 87, respectively. Finally, wires 90 and 91 of the first plurality of spaced parallel grid wires 40 extend over longitudinal end sections 72 and 73, respectively, at 92 and 93. Thus, each snap-fit section of each modular spring 16 is held in place by four grid wires 80, 84, 90, and 91.

Preferably, each pair of grid wires 80 and 84 of the second plurality of spaced parallel grid wires 42 are crimped or detented where they cross the planar top sections of each modular spring 16 at 82, 83, 86, and 87. Each grid wire 80 is crimped upward at each cross point. Each grid wire 84 is crimped downward at each cross point. These crimps allow the planar top portion 14 to lie in substantially a plane defined by the planar top sections 55 of modular springs 16 and retain the planar top sections of the modules against lateral movement relative to the grid.

The second plurality of spaced parallel grid wires 42 are not spaced evenly apart, since grid wires 80 and 84 must be close enough to lock with the snap-fit sections of each modular spring 16. Grid wires from the first plurality of spaced parallel grid wires 40 may or may not be spaced evenly apart.

Figure 4:
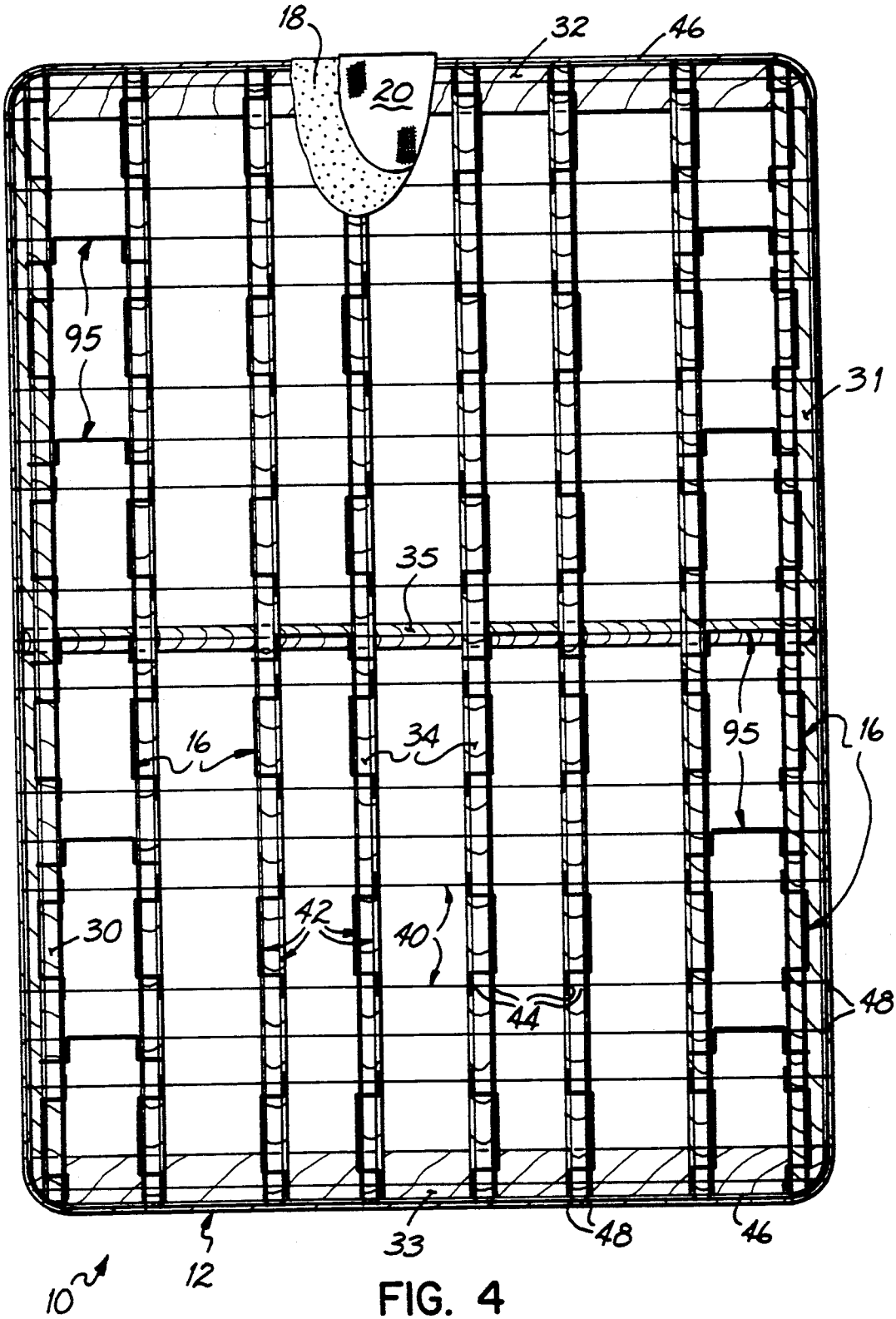
FIG. 4 is a top plan view, mostly broken away, of a foundation unit incorporating an alternative embodiment of the present invention.

In an alternative embodiment as shown in FIG. 4, one type of modular spring is used in a two spring attachment configuration in the foundation unit. The principal difference between this embodiment and the previously described embodiment of FIGS. 1–3 is that most of the modular springs are positioned to extend longitudinally but a few are positioned to extend laterally of the unit. The longitudinally extending modular springs 16 are positioned with the same longitudinal spring attachment configuration as described in the previous embodiment. The laterally or transversely extending modular springs 95 are positioned laterally (i.e., generally perpendicular to modular springs 16) but are identical in structure to modular springs 16, comprising the same planar top section 55 and two vertical legs 76 and 77. The vertical legs 76 and 77 of lateral modular springs 95 are attached to frame 12 such that the planar top section 55 straddles at least two spaced apart longitudinal slats 34, with some of the lateral modular springs 95 being interspaced along the length of cross-slat 35. In addition, the planar top section 55 of lateral modular springs 95 are connected to grid wires 40 and/or 42 of planar top portion 14 by metal clips (not shown) or other similar connector means.

While we have described only two embodiments of our invention, persons skilled in the art to which it applies will readily appreciate numerous changes and modifications which may be made without departing from the spirit of my invention. Therefore, we do not intend to be limited except by the scope of the following claims.

We claim:

1. A box spring unit comprising:

a) a rectangular frame comprising two laterally spaced longitudinal frame members, two longitudinally spaced lateral frame members and a plurality of spaced longitudinal slats;

b) a planar top portion spaced above said frame, and comprising a first plurality of spaced parallel grid wires and a second plurality of spaced parallel grid wires lying perpendicular to and connected to said first plurality of spaced parallel grid wires;

c) a plurality of longitudinal modular springs extending between said planar top portion and said frame, each said longitudinal modular spring comprising two vertical legs and a planar top section, said planar top section comprising a centermost longitudinal section and two longitudinal end sections, each said longitudinal end section being generally parallel to and offset from said centermost longitudinal section and being connected thereto by a transverse straight portion, each said longitudinal end section being connected to one of said vertical leg sections, each said vertical leg being connected to said frame such that the centermost longitudinal section of each said longitudinal modular spring is generally parallel to said longitudinal frame members;

d) snap-fit means securing each said longitudinal modular spring to said planar top portion, said snap-fit means comprising a first parallel grid wire from said second plurality of spaced parallel grid wires extending over both transverse straight portions of said longitudinal modular spring, a second parallel grid wire from said second plurality of spaced parallel grid wires extending under both transverse straight portions of said longitudinal modular spring, and a pair of parallel grid wires from said first plurality of spaced parallel grid wires, wherein one of said pair of parallel grid wires extends over one of said longitudinal end sections of said longitudinal modular spring and another of said pair of parallel grid wires extends over another of said longitudinal end sections of said longitudinal modular spring;

e) a pad overlying said planar top portion; and f) a fabric cover covering said pad, said planar top portion and all said modular springs.

2. A foundation unit comprising:

a) a frame comprising two laterally spaced longitudinal frame members, two longitudinally spaced lateral frame members and a plurality of spaced longitudinal slats;

b) a planar top portion spaced above said frame, and comprising a first plurality of spaced parallel grid wires and a second plurality of spaced parallel grid wires lying perpendicular to and connected to said first plurality of spaced parallel grid wires;

c) a plurality of longitudinal modular springs extending between said planar top portion and said frame, each said longitudinal modular spring comprising two vertical legs and a planar top section, said planar top section comprising a centermost longitudinal section and two longitudinal end sections, each said longitudinal end section being generally parallel to and offset from said centermost longitudinal section and being connected thereto by a transverse straight portion, each said longitudinal end section being connected to one of said vertical leg sections, each said vertical leg being connected to said frame such that the centermost longitudinal section of each said longitudinal modular spring is generally parallel to said longitudinal frame members; and d) snap-fit means securing each said longitudinal modular spring to said planar top portion, said snap-fit means comprising a first parallel grid wire from said second plurality of spaced parallel grid wires extending over both transverse straight portions of said longitudinal modular spring, a second parallel grid wire from said second plurality of spaced parallel grid wires extending under both transverse straight portions of said longitudinal modular spring, and a pair of parallel grid wires from said first plurality of spaced parallel grid wires, wherein one of said pair of parallel grid wires extends over one of said longitudinal end sections of said longitudinal modular spring and another of said pair of parallel grid wires extends over another of said longitudinal end sections of said longitudinal modular spring.

3. The foundation unit of claim 2 wherein said first plurality of spaced parallel grid wires are connected to said second plurality of spaced parallel grid wires by welding.

4. The foundation unit of claim 2 wherein each said parallel grid wire from said second plurality of spaced parallel grid wires is crimped at each point where said parallel grid wire crosses said transverse straight portion of said longitudinal modular spring, such that said planar top portion lies substantially in a plane defined by said planar top sections of said longitudinal modular springs.

5. A box spring unit comprising:

a) a rectangular frame comprising two laterally spaced longitudinal frame members, two longitudinally spaced lateral frame members and a plurality of spaced longitudinal slats;

b) a planar top portion spaced above said frame, and comprising a first plurality of spaced parallel grid wires and a second plurality of spaced parallel grid wires lying perpendicular to and connected to said first plurality of spaced parallel grid wires;

c) a plurality of longitudinal modular springs extending between said planar top portion and said frame, each said longitudinal modular spring comprising two vertical legs and a planar top section, said planar top section comprising a centermost longitudinal section and two longitudinal end sections, each said longitudinal end section being generally parallel to and offset from said centermost longitudinal section and being connected thereto by a transverse straight portion, each said longitudinal end section being connected to one of said vertical leg sections, each said vertical leg being connected to said frame such that the centermost longitudinal section of each said longitudinal modular spring is generally parallel to said longitudinal frame members; and d) snap-fit means securing each said longitudinal modular spring to said planar top portion, said snap-fit means comprising a first parallel grid wire from said second plurality of spaced parallel grid wires extending over both transverse straight portions of said longitudinal modular spring, a second parallel grid wire from said second plurality of spaced parallel grid wires extending under both transverse straight portions of said longitudinal modular spring, and a pair of parallel grid wires from said first plurality of spaced parallel grid wires, wherein one of said pair of parallel grid wires extends over one of said longitudinal end sections of said longitudinal modular spring and another of said pair of parallel grid wires extends over another of said longitudinal end sections of said longitudinal modular spring.

6. The box spring unit of claim 5 wherein said first plurality of spaced parallel grid wires are connected to said second plurality of spaced parallel grid wires by welding.

7. The box spring unit of claim 5 wherein each said parallel grid wire from said second plurality of spaced parallel grid wires is crimped at each point where said parallel grid wire crosses said transverse straight portion of said longitudinal modular spring, such that said planar top portion lies substantially in a plane defined by said planar top sections of said longitudinal modular springs.

8. The box spring unit of claim 5 wherein a plurality of said longitudinal modular springs are connected to and interspaced along the length of said longitudinal frame members and said longitudinal slats.

9. The box spring unit of claim 8 wherein each half of said box spring unit is generally a mirror image of the other half of said box spring unit.

10. The box spring unit of claim 8 wherein said longitudinal slats are located between said longitudinal frame members.

11. The box spring unit of claim 5 further comprising:

a plurality of lateral modular-springs extending between said planar top portion and said frame, each said lateral modular spring comprising the same elements as said longitudinal modular spring, the vertical legs of each said lateral modular spring being connected to said frame such that the centermost longitudinal section of each said lateral modular spring is generally parallel to said lateral frame members.

12. The box spring unit of claim 11 wherein each half of said box spring unit is generally a mirror image of the other half of said box spring unit.

13. The box spring unit of claim 11 wherein each said lateral modular spring is secured to said planar top portion with at least one clip.

14. The box spring unit of claim 13 wherein the centermost longitudinal section of each said lateral modular spring is connected to at least one parallel grid wire from said first plurality of spaced parallel grid wires.

* * * * *